US008182215B2

(12) United States Patent
Ito et al.

(10) Patent No.: US 8,182,215 B2
(45) Date of Patent: May 22, 2012

(54) ELECTRIC BLOWER

(75) Inventors: Koji Ito, Nagoya (JP); Yoshihiro Goto, Chita-gun (JP); Takahito Nakamura, Kariya (JP)

(73) Assignee: Denso Corporation, Kariya (JP)

( * ) Notice: Subject to any disclaimer, the term of this patent is extended or adjusted under 35 U.S.C. 154(b) by 595 days.

(21) Appl. No.: 12/378,099

(22) Filed: Feb. 11, 2009

(65) Prior Publication Data

US 2009/0208327 A1 Aug. 20, 2009

(30) Foreign Application Priority Data

Feb. 15, 2008 (JP) ..... 2008-034062

(51) Int. Cl.
*F04D 29/44* (2006.01)
*F04D 29/54* (2006.01)

(52) U.S. Cl. ..... 415/206; 416/203

(58) Field of Classification Search ..... 415/206; 416/198 R, 201 R, 203
See application file for complete search history.

(56) References Cited

U.S. PATENT DOCUMENTS

| | | | |
|---|---|---|---|
| 6,551,074 | B2 | 4/2003 | Kudo et al. |
| 2006/0263210 | A1 | 11/2006 | Wang |

FOREIGN PATENT DOCUMENTS

| | | | |
|---|---|---|---|
| JP | 10-235089 | | 9/1998 |
| JP | 11-002197 | | 1/1999 |
| JP | 11-324984 | | 11/1999 |
| JP | 2002-061596 | | 2/2002 |
| JP | 2006-007890 | | 1/2006 |
| JP | 2006-007946 | | 1/2006 |
| JP | 2008/138657 | * | 6/2008 |

OTHER PUBLICATIONS

Office action dated Jul. 21, 2010 in corresponding Chinese Application No. 200910006389.X.
Office action dated Dec. 22, 2009 in corresponding Japanese Application No. 2008-034062.

* cited by examiner

*Primary Examiner* — Chuong A Luu
*Assistant Examiner* — Nga Doan
(74) *Attorney, Agent, or Firm* — Harness, Dickey & Pierce, PLC

(57) ABSTRACT

An electric blower includes an electric motor, a first fan, a second fan, a first casing and a second casing. The electric motor includes a motor body and a rotation shaft extending from the motor body only on one axial side of the motor body. The first fan is located to the one axial side of the motor body and defines a first axis of rotation aligned with the rotation shaft. The second fan is located to the one axial side of the motor body and further than the first fan from the motor body in an axial direction. The second fan defines a second axis of rotation aligned with the rotation shaft. The first fan and the second fan are driven by a driving force generated by the electric motor. The first fan is disposed in the first casing. The second fan is disposed in the second casing.

9 Claims, 4 Drawing Sheets

ELECTRIC BLOWER

CROSS REFERENCE TO RELATED APPLICATION

This application is based on Japanese Patent Application No. 2008-34062 filed on Feb. 15, 2008, the disclosure of which is incorporated herein by reference.

FIELD OF THE INVENTION

The present invention relates to an electric blower including at least two fans, which is, for example, used for generating air for a vehicle air conditioner.

BACKGROUND OF THE INVENTION

A centrifugal electric blower having two centrifugal fans that are correspondingly disposed in scroll casings and driven by a single motor has been known as an electric blower for a vehicle air conditioner. The motor has a motor body and rotation shafts extending from axially opposite sides of the motor body. The centrifugal fans are connected to the rotation shafts. That is, the motor is a double-shaft motor having the rotation shafts on the axially opposite sides of the motor body, and thus the centrifugal fans are located to axially opposite sides of the motor body. Such a centrifugal blower is, for example, described in Japanese Unexamined Patent Application Publications JP-A-2006-7890 and JP-A-2006-7946.

With regard to the centrifugal blower having the two centrifugal fans, diameter of the centrifugal fans can be reduced, as compared with a centrifugal blower having a single fan, for generating the same volume of air. Thus, an entire size of the electric blower, particularly, a dimension in a radial direction can be reduced. Further, because an overall length of the centrifugal fans in an axial direction is increased, it is easy to improve distribution of air blown from the centrifugal blower with respect to the axial direction.

SUMMARY OF THE INVENTION

In general, manufacturing costs of a double-shaft motor is likely to increase due to some reasons such as complex bearing structure and the like, as compared with a single-shaft motor having a rotation shaft extending only from one axial side of a motor body.

Although it is desirable to improve commonality of components between various-types of electric blowers so as to reduce manufacturing costs, it is not easy to employ the double-shaft motor in an electric blower having a single fan. It is difficult to improve commonality of components between the electric blowers when the double-shaft motors are employed.

In an electric blower having the double-shaft motor, a motor body is disposed between fans, that is, between casings correspondingly housing the fans. Therefore, the electric motor can not be removed from the electric blower unless the casings are divided and separated.

The present invention is made in view of the foregoing matter, and it is an object of the present invention to provide an electric blower having at least two fans, capable of reducing manufacturing costs.

It is another object of the present invention to provide an electric blower having at least two fans, capable of improving maintainability of an electric motor.

According to an aspect of the present invention, an electric blower includes an electric motor, a first fan, a second fan, a first casing and a second casing. The electric motor includes a motor body and a rotation shaft extending from the motor body only on one axial side of the motor body. The first fan is located to the one axial side of the motor body. The first fan has a first axis of rotation aligned with the rotation shaft of the electric motor. The first fan is disposed in the first casing and driven by a driving force generated by the electric motor. The second fan is located to the one axial side of the motor body. The second fan is disposed further than the first fan from the motor body in an axial direction. The second fan has a second axis of rotation aligned with the rotation shaft. The second fan is disposed in the second casing and driven by the driving force generated by the electric motor.

In the above construction, a single-shaft motor having the rotation shaft only on one axial side of the motor body is employed as the electric motor. Accordingly, even in the electric blower having the multiple fans, manufacturing costs can be reduced.

Since the first and second fans and the first and second casings are disposed on the same axial side of the motor body, the electric motor can be easily maintained without separating the first and second fans and the first and second casings. Accordingly, maintainability of the electric motor improves.

BRIEF DESCRIPTION OF THE DRAWINGS

Other objects, features and advantages of the present invention will become more apparent from the following detailed description made with reference to the accompanying drawings, in which.

DETAILED DESCRIPTION OF EXEMPLARY EMBODIMENTS

Figure 1:
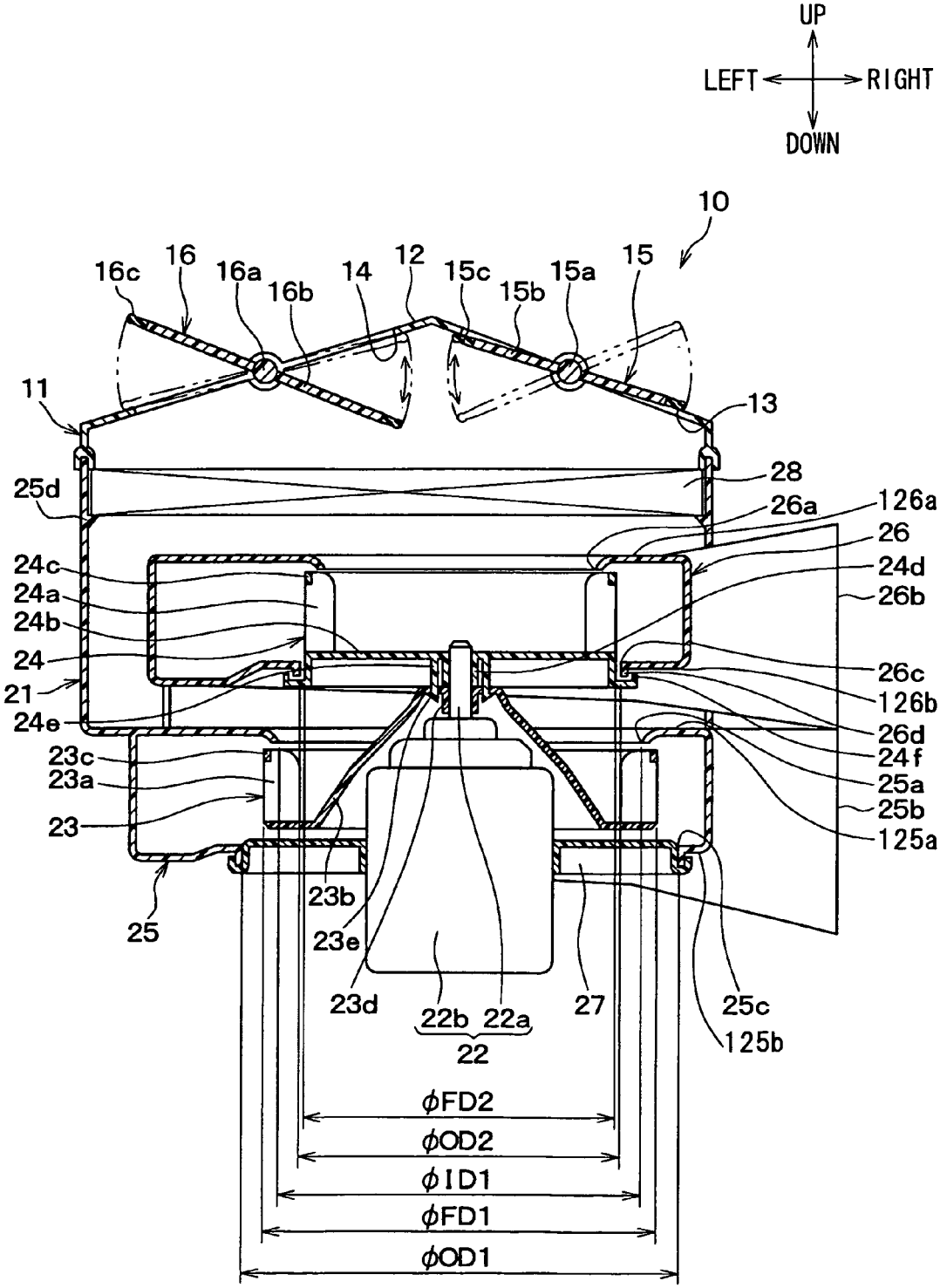
FIG. 1 is a cross-sectional view of a blower unit according to a first embodiment of the present invention.

Exemplary embodiments of the present invention will now be described with reference to the accompanying drawings. Hereinafter, like or equivalent parts are denoted by like reference numerals, and a description thereof will not be repeated.

First Embodiment

Referring to FIG. 1, in a first embodiment of the present invention, an electric bower is exemplarily employed in a blower unit 10 of in an interior unit of a vehicle air conditioner. The interior unit of the vehicle air conditioner generally includes the blower unit 10 for generating air and an air conditioning unit (not shown) for conditioning the air and introducing the conditioned air into a passenger compartment of a vehicle.

The interior unit is mounted in a space provided between a dash panel and an instrument panel in the vehicle. The dash panel is a member separating the passenger compartment from an engine compartment. The instrument panel is disposed at a front-most location of the passenger compartment. In the space between the dash panel and the instrument panel, the air conditioning unit is arranged at a substantially middle position with respect to a vehicle width direction, such as a vehicle right and left direction, and the blower unit 10 is offset from the middle position to a side, such as an assistant driver's seat side.

The air conditioning unit forms an air passage through which air generated by the blower unit 10 flows. A cooling heat exchanger, a heating heat exchanger, an air mix door, and the like are arranged in the air passage. The cooling heat exchanger cools the air generated by the blower unit 10. The heating heat exchanger heats the cooled air. The air mix door is disposed to control the volume of the cooled air to be heated by the heating heat exchanger.

The cooling heat exchanger is located at an upstream position in the air passage of the air conditioning unit. The cooling heat exchanger is, for example, an evaporator of a vapor compression refrigerant cycle. The heating heat exchanger is located downstream of the cooling heat exchanger in the air passage. The heating heat exchanger is, for example, a heater core for heating the air using heat of an engine coolant flowing inside thereof.

The air mix door is disposed between the cooling heat exchanger and the heating heat exchanger. By continuously varying an opening degree of the air mix door, a volume ratio of the cooled air to be introduced to the heating heat exchanger to the cooled air bypassing the heating heat exchanger can be continuously varied. Namely, the air mix door serves as temperature control means for controlling the temperature of air to be introduced in the passenger compartment.

The air the temperature of which has been controlled (hereinafter, conditioned air) is introduced to openings formed at downstream portions of the air conditioning unit and further introduced into ducts coupled to the openings. The conditioned air is further blown out from outlet ports of the passenger compartment, such as face outlets, foot outlets and a defroster outlet. For example, the conditioned air is blown toward a face area and a foot area of a passenger from the face outlet and the foot outlet, respectively. Also, the conditioned air is blown toward a windshield of the vehicle from the defroster outlet.

Next, a structure of the blower unit 10 of the present embodiment will be described in detail with reference to FIG. 1. In FIG. 1, an up and down arrow and a left and right arrow denote respective directions when the blower unit 10 is mounted in a vehicle. Further, a direction perpendicular to a paper surface of FIG. 1 corresponds to a front and rear direction of the vehicle.

The blower unit 10 generally includes an inside/outside air switching device 11 and an electric blower 21 integrated with each other. The electric blower 21 is disposed downstream of the inside/outside air switching device 11, such as under the inside/outside air switching device 11.

The inside/outside air switching device 11 has a case 12 forming an outline of the inside/outside air switching device 11. For example, the case 12 is made of a resin, such as polypropylene, having some elasticity and high strength.

The case 12 has an outside air suction port 13 for introducing air outside of the passenger compartment (hereinafter, outside air) into the case 12 and an inside air suction port 14 for introducing air inside of the passenger compartment (hereinafter, inside air) into the case 12. Although not illustrated, the outside air suction port 13 is in communication with an opening formed in the dash panel. Thus, the outside air is introduced in the case 12 through the opening of the dash panel and the outside air suction port 13.

The case 12 forms an air passage therein for introducing the outside air suctioned from the outside air suction port 13 and the inside air suctioned from the inside air suction port 12 toward the electric blower 21. An outside air door 15 and an inside air door 16 are disposed in the air passage of the case 12. The outside air door 15 is operable to open and close the outside air suction port 13. The inside air door 16 is operable to open and close the inside air suction port 14.

The outside air door 15 is made of the same material as the case 12, for example. The outside air door 15 includes a rotation shaft 15*a* rotatably supported through the case 12 and a door body 15*b* rotatable with the rotation shaft 15*a*. For example, the outside air door 15 is a butterfly door. Thus, the door body 15*b* has a substantially plate shape and the rotation shaft 15*a* is disposed at a substantially middle portion of the door body 15*b*.

Further, the outside air door 15 has a sealing member 15*c* along a peripheral edge of the door body 15*b*. The sealing member 15*c* is configured to be in contact with a sealing surface formed along a perimeter of the outside air suction port 13 when the outside air door 15 is in a closed position to close the outside air suction port 13. For example, the sealing member 15*c* is made of an elastic material, such as a thermoplastic elastomer. The sealing member 15*c* has a lip-type sealing structure to make contact with the sealing surface of the case 12 while being elastically deformed when the outside air door 15 is in the closed position.

The thermoplastic elastomer is a material having rubber elasticity under an ordinal temperature and having fluidity when melted under a high temperature. Thus, the thermoplastic elastomer can be molded by injection molding, similar to a thermoplastic resin.

The inside air door 16 basically has a similar structure as the outside air door 15. The inside air door 16 includes a rotation shaft 16*a* rotatably supported through the case 12, a door body 16*b* rotatable with the rotation shaft 16*a*, and a sealing member 16*c* along a peripheral edge of the door body 16*b*. The inside air door 16 is, for example, a butterfly door. Thus, the door body 16*b* has a plate shape, and the rotation shaft 16*a* is disposed at a middle portion of the door body 16*b*.

Although not illustrated, the rotation shafts 15*a* of the outside air door 15 and the rotation shaft 16*a* of the inside air door 16 are connected to a common servomotor as a driving device through linking members (not shown). An operation of the servomotor is controlled by a control signal outputted from an air conditioner control unit.

In an inside air mode, the outside air door 15 is moved to the closed position shown by a solid line in FIG. 1 and the inside air door 16 is moved to an open position shown by a solid line in FIG. 1. In an outside air mode, the outside air door 15 is moved to an open position shown by a double-dashed chain line in FIG. 1 and the inside air door 16 is moved to a closed position shown by a double-dashed chain line in FIG. 1.

Next, a structure of the electric blower 21 will be described in detail. The electric blower 21 generally includes an electric motor 22, a first fan 23 and a second fan 24. For example, the first and second fans 23, 24 are centrifugal fans, and thus the electric blower 21 constitutes a centrifugal blower.

The first and second centrifugal fans 23, 24 are driven by the single motor 22. The electric motor 22 has a rotation shaft 22*a* and a motor body 22*b*. The rotation shaft 22*a* extends from the motor body 22*b* only in one axial direction. That is, the electric motor 22 is a single shaft motor having a rotation shaft only on one axial side of a motor body.

The electric motor 22 can be either a d.c. motor or an a.c. motor. An operation of the electric motor 22 is controlled by a control signal, such as a control voltage signal, a control frequency signal or the like, outputted from the air conditioner control unit.

The first centrifugal fan 23 includes first blades 23*a*, a first boss part (e.g., first boss plate) 23*b* and a first ring 23*c*. The first blades 23*a* are arranged at equal intervals around the rotation shaft 22*a* of the electric motor 22. The first boss part 23*b* supports first axial ends of the first blades 23*a* and transmits a driving force generated by the electric motor 22 to the first blades 23*a*. The first ring 23*a* has a ring shape and supports second axial ends of the first blades 23*a*.

In the present embodiment, the first blades 23*a*, the first boss part 23*b* and the first ring 23*c* are integrally formed with each other of a resin, such as polypropylene. Alternatively, the first blades 23*a*, the first boss part 23*b* and the first ring 23*c* can be formed separately from each other and then integrated with each other, such as by bonding, welding and the like.

The first boss part 23*b* is formed with a first boss portion 23*d* at a center of rotation thereof. The first boss portion 23*d* has an engagement hole in which the rotation shaft 22*a* of the electric motor 22 is fitted. The first boss part 23*b* is coaxially coupled to the rotation shaft 22*a* of the electric motor 22 by fitting the rotation shaft 22*a* in the first boss portion 23*d*. Thus, the first centrifugal fan 23 is disposed such that an axis of rotation thereof is aligned with the rotation shaft 22*a* of the electric motor 22.

For example, the first boss portion 23*d* is engaged with the rotation shaft 22*a* of the electric motor 22 by an engagement structure, such as D-shaped engagement, so that rotation of the first boss portion 23*d* relative to the rotation shaft 22*a* is restricted. In this case, the engagement hole of the first boss portion 23*d* has a D-shape and the rotation shaft 22*a* of the electric motor 22 has a shape corresponding to the shape of the engagement hole at least at a portion coupled to the first boss portion 23*d*. Thus, the first boss part 23*b* rotates with rotation of the rotation shaft 22*a*. Also, the first boss portion 23*d* is fixed to the rotation shaft 22*a*, such as by press-fitting, so that the first boss portion 23*d* is restricted from moving in the longitudinal direction of the rotation shaft 22*a*, that is, in the axial direction.

The second centrifugal fan 24 has second blades 24*a*, a second boss part (e.g., second boss plate) 24*b* and a second ring 24*c*. The second blades 24*a* are arranged at equal intervals around the rotation shaft 22*a*. The second boss part 24*b* supports first axial ends of the second blades 24*a*. The second ring 24*c* has a ring shape and supports second axial ends of the second blades 24*a*. The second boss part 24*b* is formed with a second boss portion 24*d* at a center of rotation thereof. The rotation shaft 22*a* is fitted in the second boss portion 24*d*.

The second centrifugal fan 24 basically has the same structure as the first centrifugal fan 23, but is different from the first centrifugal fan 23 as follows. First, the second centrifugal fan 24 is disposed further than the first centrifugal fan 23 from the motor body 22*b* of the electric motor 22.

The second boss part 24*b* has fixing projections 24*e* projecting toward the first boss part 23*b* in the axial direction. In FIG. 1, two fixing projections 24*e* are illustrated, for example. On the other hand, the first boss part 23*b* is formed with fitting holes 23*e* to receive the fixing projections 24*e* of the second boss part 24*b*.

Because the fixing projections 24*e* are fitted in the fitting holes 23*e*, the first boss part 23*b* and the second boss part 24*b* are fixed to each other. That is, the first centrifugal fan 23 and the second centrifugal fan 24 are fixed to each other through engagements between the fitting holes 23*e* and the fixing projections 24*e*. The fixing projections 24*e* have nail portions at ends thereof so as to restrict separation from the fitting holes 23*e*.

The second boss part 24*b* has a substantially flat plate shape. On the other hand, the first boss part 23*b* has a cup shape defining a recess and having a center of rotation at a center portion protruding toward the second centrifugal fan 24. In other words, the first boss part 23*b* has a shape in which a middle portion projects in the same direction as the rotation shaft 22*a*. At least a portion of the motor body 22*b* from which the rotation shaft 22*a* extends, such as an upper portion in FIG. 1, is received in the recess of the first boss part 23*b*.

An upper portion of the first centrifugal fan 23, such as the first ring 23*c*, has an outside diameter ϕFD1 that is greater than an outside diameter ϕFD2 of an upper portion of the second centrifugal fan 24, such as the second ring 24*c*.

The first centrifugal fan 23 and the second centrifugal fan 24 are rotatably disposed in a first casing 25 and a second casing 26, respectively. The first casing 25 forms a first air passage therein to allow air blown by the first centrifugal fan 23 to flow.

The first casing 25 is a scroll casing and has a shape in which a distance between the rotation shaft 22*a* and an outer wall thereof, that is, a scroll radius gradually increases in a direction of rotation of the first centrifugal fan 23. Thus, the first air passage has a scroll shape and a cross-sectional area thereof gradually increases in the direction of the rotation of the first centrifugal fan 23.

The first scroll casing 25 has a first suction port 25*a* in a first wall 125*a* that is perpendicular to the rotation shaft 22*a*. The first suction port 25*a* has a circular shape and allows air to flow into an inner space of the first centrifugal fan 23. The first wall 125*a* of the first scroll casing 25 has a bell-mouth portion on a perimeter of the first suction port 25*a*. The first scroll casing 25 further has a first outlet port 25*b* at a scroll end of the first air passage.

The first scroll casing 25 has a first installation hole 25*c* on a second wall 125*b* that is perpendicular to the rotation shaft 22*a* and opposed to the first wall 125*a* in the axial direction. The first wall 125*a* is further than the second wall 125*b* from the motor body 22*b* in the axial direction. The first installation hole 25*c* has a circular shape. The first centrifugal fan 23 is capable of being installed in and separated from the first scroll casing 25 through the first installation hole 25*c*.

The electric motor 22 is fixed to the second wall 125*b* through a bracket 27. The bracket 27 is, for example, made of a metal or a resin. The bracket 27 holding the motor body 22*b* is disposed in the first installation hole 25*c* and fixed to the second wall 125*b*. The first installation hole 25*c* has a diameter ϕOD1 that is greater than a diameter ϕID1 of the first suction port 25*a*.

The first scroll casing 25 has an extension wall 25*d* extending from a peripheral portion of the first wall 125*a* toward the case 12 of the inside/outside air switching device 11. The extension wall 25*d* is connected to the case 12. Thus, the air suctioned in the case 12 from the outside air suction port 13 or the inside air suction port 14 is introduced in the first suction port 25*a* after passing through an air filter 28.

The air filter 28 is disposed at a connecting portion between the extension wall 25*d* and the case 12. The air filter 28 serves to remove foreign materials, such as dust, from the air suctioned in the case 12 from the outside air suction port 13 or the inside air suction port 14.

The second casing 26 forms a second air passage therein for allowing air blown out from the second centrifugal fan 24 to flow. The second casing 26 is a scroll casing and basically has the similar structure as the first scroll casing 25. The second scroll casing 26 has a second suction port 26*a*, a second outlet port 26*b* and a second installation hole 26*c*, similar to the first scroll casing 25. The second suction port 26*a* is formed in a first wall 126*a* of the second scroll casing 26. The second installation hole 26*c* is formed in a second wall 126*b* of the second scroll casing 26, which is opposed to the first wall 126*a* in the axial direction. The first wall 126*a* is further than the second wall 126*b* from the motor body 22*b* in the axial direction.

The second installation hole 26*c* has a diameter ϕOD2 that is greater than a diameter ϕFD2 of an upper portion of the second centrifugal fan 24, such as, the second ring 24*c*. In other words, the diameter ϕOD2 of the second installation hole 26*c* is greater than the diameter ϕFD2 of a portion of the second centrifugal fan 24, the portion being housed in the second scroll casing 26.

The second wall 126*b* of the second scroll casing 26 has a projection 26*d* along a perimeter of the second installation hole 26*c*. The projection 26*d* has an annular shape and projects toward the motor body 22*b*. The second centrifugal fan 24 has a groove portion 24*f* on its lower portion, such as along a peripheral end of the second boss part 24*b*. The groove portion 24*f* forms an annular groove therein and has a substantially U-shaped cross-section. The groove portion 24*f* is configured to surround an inner surface and an outer surface of the projection 26*d* throughout in a circumferential direction.

The projection 26*d* is received in the groove of the groove portion 24*f*. Thus, a labyrinthine sealing structure is provided by the projection 26*d* and the groove portion 24*f*. The labyrinthine sealing structure restricts air from leaking through a clearance between the second wall 126*b* forming the second installation hole 26*c* and the second centrifugal fan 24.

The second centrifugal fan 24 is disposed further than the first centrifugal fan 23 from the motor body 22*b* in the axial direction. Thus, the second scroll casing 26 is disposed in a space provided between the air filter 28 and the first wall 125*a* of the first scroll casing 25. The first wall 126*a* of the second scroll casing 26 is opposed to the air filter 28. The air passing through the air filter 28 is also introduced in the second suction port 26*a*.

For example, the first scroll casing 25 and the second scroll casing 26 are made of the same material as the case 12 of the inside/outside air switching device 11. The first scroll casing 25 and the second scroll casing 26 are integrated together with the case 12. For example, the first scroll casing 25 and the second scroll casing 26 are connected by using fixing members such as metal springs, clips, screws and the like. Alternatively, the first scroll casing 25 and the second scroll casing 26 can be connected such as by bonding, welding or the like.

In the present embodiment, the outside diameter ϕFD2 of the portion of the second centrifugal fan 24, the diameter of the second installation hole ϕOD2, the diameter ϕID1 of the first suction port 25*a*, the outside diameter ϕFD1 of the first centrifugal fan 23, and the diameter ϕOD1 of the first installation hole 25*c* satisfy the relationship of ϕOD1>ϕFD1>ϕID1>ϕOD2>ϕFD2.

The first centrifugal fan 23 is capable of being installed in and separated from the first scroll casing 25 through the first installation hole 25*c*. The second centrifugal fan 24 is capable of being installed in and separated from the second scroll casing 26 through the second installation hole 26*c*, the first suction port 25*a* and the first installation hole 25*c*.

Next, an operation of the present embodiment will be described. When the vehicle air conditioner is operated, the electric motor 22 is rotated in accordance with the control signal outputted from the air conditioner control unit. Thus, the first centrifugal fan 23 and the second centrifugal fan 24 are rotated by the driving force generated by the electric motor 22, thereby to generate air to be introduced in the passenger compartment.

Specifically, the first centrifugal fan 23 suctions the air from the first suction port 25*a* in the axial direction and blows the air into the first air passage in a radially outward direction. The air blown by the first centrifugal fan 23 is introduced in the air conditioning unit through the first outlet port 25*b*. The second centrifugal fan 24 suctions the air from the second suction port 26*a* in the axial direction and blows the air into the second air passage in a radially outward direction. The air blown by the second centrifugal fan 24 is introduced in the air conditioning unit through the second outlet port 26*b*.

The air conditioner control unit determines an air suction mode between the inside air mode and the outside air mode in accordance with a target temperature of air to be introduced in the passenger compartment. To conduct a control operation in the inside air suction mode, the air conditioner control unit outputs a control signal to the servomotor so as to operate the outside air door 15 and the inside air door 16 to the closed position and the open position, respectively, as shown by the solid lines in FIG. 1. Thus, the outside air suction port 13 is closed, and the inside air suction port 14 is open. Accordingly, the inside air is introduced in the interior unit.

To conduct a control operation in the outside air mode, the air conditioner control unit outputs a control signal to the servomotor so as to operate the outside air door 15 and the inside air door 16 to the open position and the closed position, respectively, as shown by the double-dashed chain lines in FIG. 1. Thus, the outside air suction port 13 is open and the inside air suction port 14 is closed. Accordingly, the outside air is introduced in the interior unit.

Next, advantageous effects of the electric blower 21 of the present embodiment will be described. In the present embodiment, the electric blower 21 has the single-shaft motor as the electric motor 22. Therefore, even in the electric blower having the two centrifugal fans 23, 24, manufacturing costs of the electric motor 22 itself can be reduced. The single-shaft motor is commonly used for electric blowers each having a single fan. Thus, manufacturing costs of the electric blowers are reduced by improving commonality of the electric motors.

The first boss part 23*b* and the second boss part 24*b* are fixed to each other. Further, the rotation shaft 22*a* is fixed to the first and second boss portions 23*d*, 24*d* formed at the center of rotation of the first and second boss parts 23*b*, 24*b*. Therefore, misalignment of the axes of rotation of the first and second centrifugal fans 23, 24 is reduced. Moreover, at least the portion of the motor body 22*b* is disposed in the recess of the first boss part 23*b*. Therefore, a dimension of the electric blower 21 in the axial direction can be reduced.

The first and second suction ports 25*a*, 26*a* are open in the same direction. Therefore, the flow direction of air suctioned into the first scroll casing 25 and the flow direction of air suctioned into the second scroll casing 26 are uniformed. Accordingly, even in a structure in which air is suctioned into the first and second centrifugal fans 23, 24 from the inside/outside air switching device 11, which is disposed at one location, rapid change of the flow direction of the air suctioned into the first and second centrifugal fans 23, 24 is reduced. Accordingly, pressure loss in suctioning the air is reduced.

The first and second centrifugal fans 23, 24 and the first and second scroll casings 25, 26 are mounted to the same axial side of the electric motor 22. Therefore, the electric motor 22 is easily maintained without removing the first and second centrifugal fans 23, 24 and the first and second scroll casings 25, 26.

Since the diameter ϕOD2 of the second installation hole 26*c*, the outside diameter ϕFD2 of the portion of the second centrifugal fan 24 housed in the second scroll casing 26, the diameter ϕID1 of the first suction port 25*a*, the outside diameter ϕFD1 of the first centrifugal fan 23, and the diameter ϕOD1 of the first installation hole 25*c* satisfy the relationship of ϕOD1>ϕFD1>ϕID1>ϕOD2>ϕFD2. Therefore, the first and second centrifugal fans 23, 24 can be installed in and separated from the first and second scroll casings 25, 26 while being held on the rotation shaft 22*a* of the electric motor 22.

Accordingly, maintainability of the electric motor 22 and the first and second centrifugal fans 23, 24 further improves.

Even in a structure in which the first and second centrifugal fans 23, 24 are attachable to and detachable from the first and second scroll casings 25, 26 while being held on the rotation shaft 22*a* of the electric motor 22, the clearance between the second installation hole 26*c* and the second centrifugal fan 24 is sealed by the labyrinthine sealing structure, air leakage through the clearance is reduced. Accordingly, air blowing capacity of the electric blower 21 improves.

Second Embodiment

Figure 2:
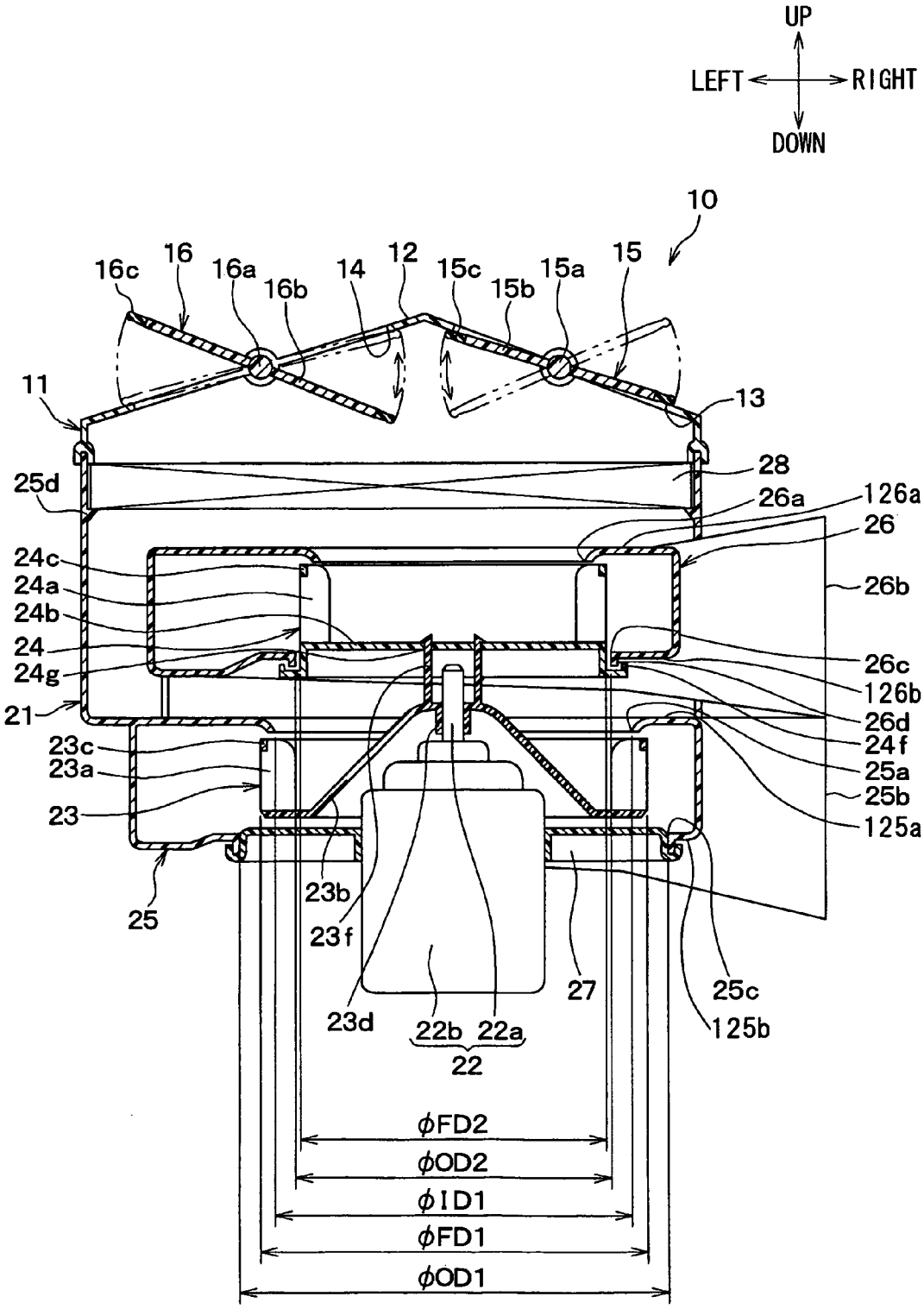
FIG. 2 is a cross-sectional view of a blower unit according to a second embodiment of the present invention.

Referring to FIG. 2, in a second embodiment of the present invention, the first boss portion 23*d* of the first boss part 23*b* is fixed to the rotation shaft 22*a* of the electric motor 22, but the second boss portion 24*d* of the second boss part 24*b* is not directly fixed to the rotation shaft 22*a*.

The first boss part 23*b* has fixing projections 23*f* projecting toward the second boss part 24*b* in the axial direction. The fixing projections 23*f* are disposed on a periphery of the first boss portion 23*d*, for example. In FIG. 2, two fixing projections 23*f* are exemplarily illustrated. The second boss part 24*b* has fitting holes 24*g* to receive the fixing projections 23*f* therein.

The first boss part 23*b* and the second boss part 24*b* are fixed to each other by fitting the fixing projections 23*f* in the fitting holes 24*g*. Thus, the first centrifugal fan 23 and the second centrifugal fan 24 are fixed to each other. The fixing projections 23*f* have nail portions at ends thereof so as to restrict separation from the fitting holes 24*g*.

In the present embodiment, the second boss part 24*b* is not directly fixed to the rotation shaft 22*a* of the electric motor 22. Therefore, the second boss part 24 does not have the second boss portion 24*d* of the first embodiment. Structures other than the above are similar to those of the first embodiment.

In the present embodiment, manufacturing costs of the electric blower 21 can be reduced and the electric motor 22 can be easily maintained by the similar reasons to the first embodiment. Further, the second boss part 24*b* does not have the second boss portion 24*d*. Therefore, flexibility in designing the second boss part 24*b* improves. For example, the second boss part 24*b* has a shape to adapt to a flow of air inside of the second centrifugal fan 24.

Third Embodiment

Figure 3:
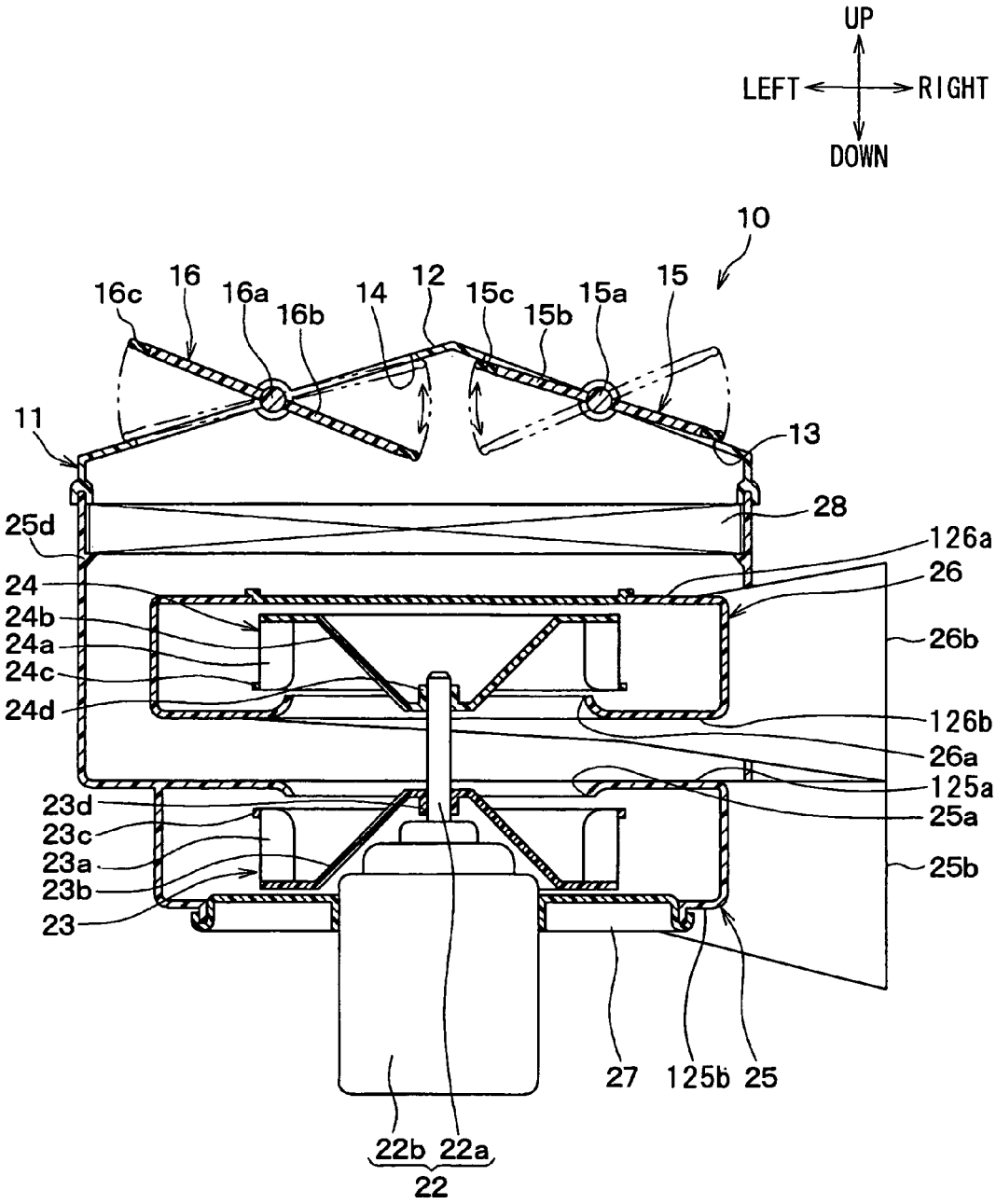
FIG. 3 is a cross-sectional view of a blower unit according to a third embodiment of the present invention.

Referring to FIG. 3, in a third embodiment of the present invention, the second scroll casing 26 has the second suction port 26*a* on the second wall 126*b* facing the first wall 125*a* of the first scroll casing 25, instead on the first wall 126*a*. That is, the second suction port 26*a* is disposed to oppose the first suction port 25*a* of the first scroll casing 25 in the axial direction.

The first boss part 23*b* has the first boss portion 23*d* fixed to the rotation shaft 22*a* of the electric motor 22. Likewise, the second boss part 24*b* has the second boss portion 24*d* fixed to the rotation shaft 22*a* of the electric motor 22. The first centrifugal fan 23 and the second centrifugal fan 24 have the same shape.

Structures other than the above are similar to those of the first embodiment.

In the present embodiment, the first and second centrifugal fans 23, 24 cannot be installed in and separated from the first and second scroll casings 25, 26 while being held on the rotation shaft 22 of the electric motor 22. However, since the electric blower 21 employs the single-shaft motor 22, maintainability of the electric motor 22 improves. Further, the manufacturing costs of the electric blowers are reduced by improvement of commonality of the electric motors.

In addition, since the first centrifugal fan 23 and the second centrifugal fan 24 have the same shape, commonality of the parts further improves. Accordingly, the manufacturing costs of the electric blowers are further reduced.

Fourth Embodiment

Figure 4:
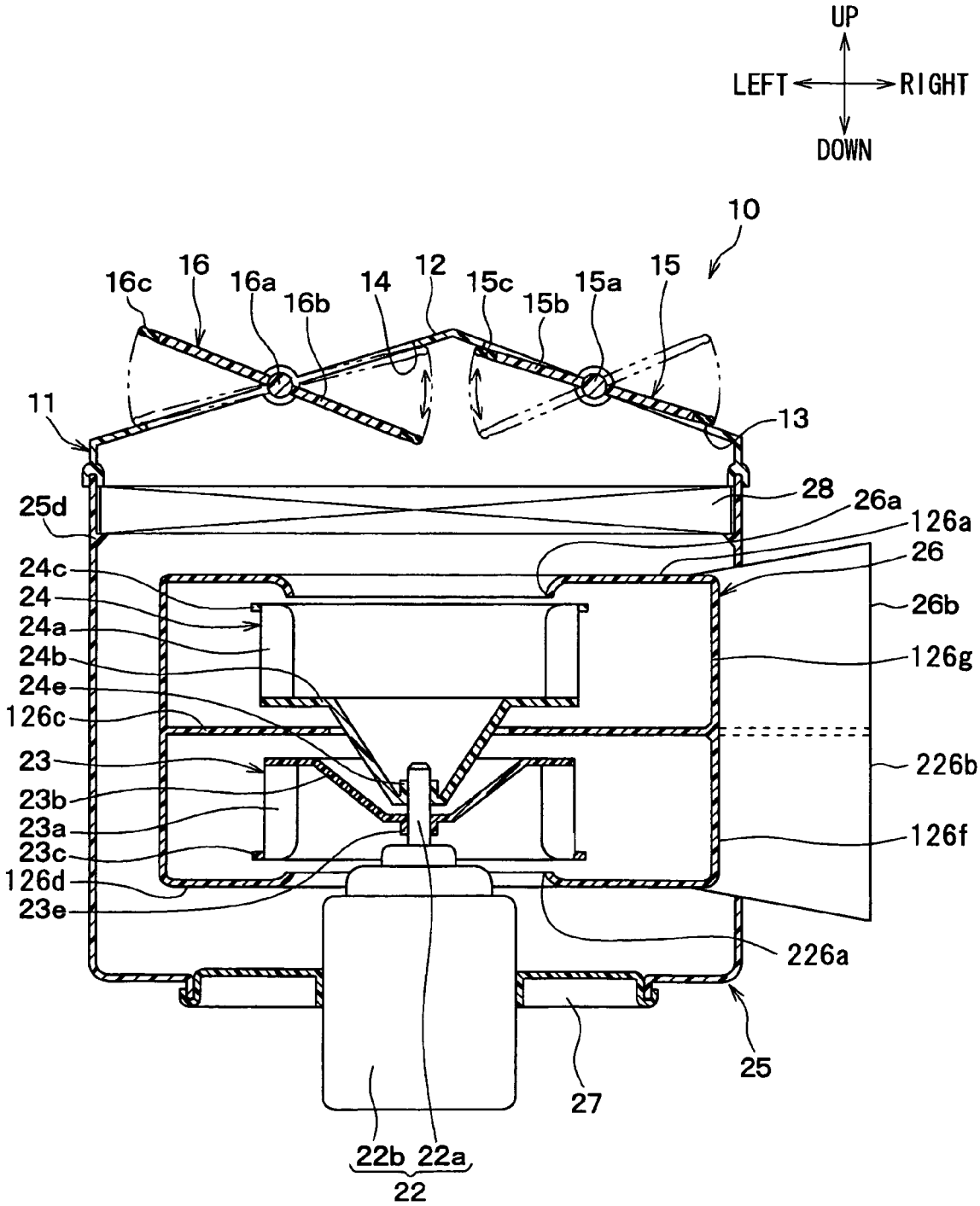
FIG. 4 is a cross-sectional view of a blower unit according to a fourth embodiment of the present invention.

Referring to FIG. 4, in a fourth embodiment of the present invention, the second scroll casing 26 has a separation wall 126*c* to separate an inner space of the second scroll casing 26 into a first space 126*f* as the first casing and a second space 126*g* as the second casing in the axial direction. The first centrifugal fan 23 is disposed in the first space 126*f* as the first casing, and the second centrifugal fan 24 is disposed in the second space 126*g* as the second casing. The first space 126*f* provides the first air passage through which the air blown by the first centrifugal fan flows on a periphery of the first centrifugal fan 23. The second space 126*g* provides the second air passage through which the air blown by the second centrifugal fan flows on a periphery of the second centrifugal fan 24. The first space 126*f* is closer to the motor body 22*b* than the second space 126*g*.

The second scroll casing 26 has the first wall 126*a* on a side adjacent to the air filter 28 and a second wall 126*d* on a side adjacent to the motor body 22*b*. The first wall 126*a* has the second suction port 26*a* for suctioning air into the second space 126*g*. The second wall 126*d* has a first suction port 226*a* for suctioning air into the first space 126*f*. The second scroll casing 26 has a first outlet port 226*b* through which the air blown by the first centrifugal fan 23 is blown out from the first air passage and the second outlet port 26*b* through which the air blown by the second centrifugal fan 24 is blown out from the second air passage. The first outlet port 226*b* is separated from the second outlet port 26*b* by the separation wall 126*c*.

Also in the present embodiment, the first centrifugal fan 23 and the second centrifugal fan 24 are mounted to the same axial side of the motor body 22*b*. That is, the electric blower 21 employs the singe-shaft motor 22. Therefore, maintainability of the electric motor 22 improves, similar to the third embodiment. Also, because commonality of the electric motor 22 improves, manufacturing costs of the electric blowers reduce.

Other Embodiments

The present invention is not limited to the above described embodiments, but may be modified in various other ways. Further, the above embodiments can be modified as follows.

(1) In the above embodiments, the first fan 23 and the second fan 24 are the centrifugal fans. However, the first fan 23 and the second fan 24 are not limited to the centrifugal fans. For example, one of or both of the first and second fans 23, 24 can be a cross-flow fan in which air is suctioned from one radial side and is blown out from an opposite radial side in a radial direction.

(2) In the second embodiment, the first and second centrifugal fans 23, 24 are fixed to each other and only the first centrifugal fan 23 is directly fixed to the rotation shaft 22*a* of the electric motor 22. Alternatively, the first and second centrifugal fans 23, 24 are fixed to each other, and only the second centrifugal fan 24 can be directly fixed to the rotation shaft 22*a* of the electric motor 22.

Further, the fixing structure of the first and second centrifugal fans 23, 24 of any one of the embodiments can be employed in another one of the embodiments.

For example, in the first embodiment, the first centrifugal fan 23 and the second centrifugal fan 24 are respectively directly fixed to the rotation shaft 22*a* of the electric motor 22 without fixing to each other, similar to the third and fourth embodiments.

(3) The labyrinthine sealing structure of the first and second embodiments is not limited to the above discussed and illustrated shape. The labyrinthine sealing structure can be constructed in any other different shapes.

(4) The outside air door 15 and the inside air door 16 are not limited to the butterfly doors, but can be constructed of any other types of doors. For example, one of or both of the outside air door 15 and the inside air door 16 can be constructed of a rotary door. As another example, the outside air suction port 13 and the inside air suction port 14 can be opened and closed by a single door member.

(5) In the third and fourth embodiments, the first and second scroll casings 25, 26 can be configured to be separable in a radial direction or/and in the axial direction, so that the first and second centrifugal fans 23, 24 can be housed in the first and second scroll casings 25, 26.

Additional advantages and modifications will readily occur to those skilled in the art. The invention in its broader term is therefore not limited to the specific details, representative apparatus, and illustrative examples shown and described.

What is claimed is:

1. An electric blower comprising:

an electric motor including a motor body and a rotation shaft extending from the motor body only on one axial side of the motor body, the electric motor generating a driving force;

a first casing;

a second casing;

a first fan located to the one axial side of the motor body and disposed in the first casing, the first fan defining a first axis of rotation aligned with the rotation shaft and being driven by the driving force; and a second fan located to the one axial side of the motor body and further than the first fan from the motor body in an axial direction, the second fan disposed in the second casing, the second fan defining a second axis of rotation aligned with the rotation shaft and being driven by the driving force; wherein the first casing has a first suction port for suctioning air into the first casing, the second casing has a second suction port for suctioning air into the second casing, the first suction port and the second suction port are open in the same direction;

the first casing has a first wall and a second wall opposed to the first wall in an axial direction, the first wall has the first suction port, the second wall has a first installation hole provided for allowing the first and second fans to pass through when being installed in and separated from the first and second casings, the second casing has a third wall and a fourth wall opposed to the third wall in the axial direction, the third wall has the second suction port, the fourth wall has a second installation hole provided for allowing the second fan to pass through when being installed in and separated from the second casing, the fourth wall being opposed to the first wall in the axial direction, and the first fan, the second fan, the first installation hole, the second installation hole and the first suction port satisfy a relationship of)

$$\phi OD1>\phi FD1>\phi ID1>\phi OD2>\phi FD2$$

in which $\phi$OD1 represents a diameter of the first installation hole, $\phi$FD1 represents an outside diameter of the first fan, $\phi$ID1 represents a diameter of the first suction port, $\phi$OD2 represents a diameter of the second installation hole, and $\phi$FD2 represents an outside diameter of a portion of the second fan, the portion being disposed inside of the second casing.

2. The electric blower according to claim 1, wherein the first fan includes a plurality of first blades arranged around the first axis of rotation and a first boss part connecting to the first blades to transmit the driving force to the first blades, and the second fan includes a plurality of second blades arranged around the second axis of rotation and a second boss part connecting to the second blades to transmit the driving force to the second blades.

3. The electric blower according to claim 2, wherein the first boss part has a first boss portion at a center thereof, the second boss part has a second boss portion at a center thereof, and the first boss portion and the second boss portion are fixed to the rotation shaft, respectively.

4. The electric blower according to claim 3, wherein the second boss portion has a projection projecting toward the first boss portion and engaged with the first boss portion.

5. The electric blower according to claim 2, wherein the first boss part and the second boss part are fixed to each other, and only one of the first boss part and the second boss part is fixed to the rotation shaft.

6. The electric blower according to claim 2, wherein the first boss part has a cup shape defining a recess therein, and at least a portion of the motor body is received in the recess of the first boss part.

7. The electric blower according to claim 1, wherein an outer peripheral portion of the second fan and a perimeter of the second installation hole of the fourth wall constitute labyrinthine sealing structure to reduce a clearance therebetween.

8. The electric blower according to claim 1, further comprising:

a bracket supporting the motor body, wherein the bracket is disposed in the first installation hole and fixed to the second wall of the first casing.

9. The electric blower according to claim 1, wherein the first casing and the second casing are integrated with each other.

* * * * *